US005794397A

United States Patent [19]

Ludwig

[11] Patent Number: 5,794,397

[45] Date of Patent: Aug. 18, 1998

[54] CLEAN ROOM CEILING STRUCTURE LIGHT FIXTURE WIREWAY

[75] Inventor: Craig S. Ludwig, White Salmon, Wash.

[73] Assignee: Cleanpak International, Inc., Clackamas, Oreg.

[21] Appl. No.: 756,228

[22] Filed: Nov. 25, 1996

Related U.S. Application Data

[62] Division of Ser. No. 390,803, Feb. 14, 1995, Pat. No. 5,613,759, which is a continuation of Ser. No. 292,055, Aug. 17, 1994, abandoned, which is a continuation of Ser. No. 166,593, Dec. 13, 1993, abandoned, which is a continuation of Ser. No. 959,495, Oct. 9, 1992, abandoned, which is a continuation of Ser. No. 739,693, Aug. 2, 1991, abandoned, which is a continuation-in-part of Ser. No. 720,186, Jun. 24, 1991, abandoned.

[51] Int. Cl.[6] ..... E04B 2/00

[52] U.S. Cl. ..... 52/506.08; 52/28; 52/506.06; 52/506.07

[58] Field of Search ..... 52/28, 506.06, 52/506.07, 506.08; 362/147, 148, 150, 223

[56] References Cited

U.S. PATENT DOCUMENTS

| | | | |
|---|---|---|---|
| 3,730,072 | 5/1973 | Soderlund | 454/298 |
| 3,984,221 | 10/1976 | Cotton | 454/298 |
| 4,217,121 | 8/1980 | Fichter | 454/296 |
| 4,334,899 | 6/1982 | McConnell | 55/507 |
| 4,407,011 | 9/1983 | Lahm | 362/150 |
| 4,461,205 | 7/1984 | Shuler | 55/507 |
| 4,518,405 | 5/1985 | Lough | 55/483 |
| 4,549,472 | 10/1985 | Endo | 55/483 |
| 4,554,766 | 11/1985 | Ziemer | 55/483 |
| 4,580,381 | 4/1986 | Sodec | 55/483 |
| 4,600,419 | 7/1986 | Mattison | 55/483 |
| 4,603,618 | 8/1986 | Soltis | 55/483 |
| 4,608,066 | 8/1986 | Cadwell | 55/483 |
| 4,671,811 | 6/1987 | Cadwell | 55/483 |
| 4,678,487 | 7/1987 | Cadwell | 55/483 |
| 4,683,699 | 8/1987 | Larsson | 55/483 |
| 4,710,208 | 12/1987 | Ziemer et al. | 52/506.07 |
| 4,713,099 | 12/1987 | Schroeder | 55/494 |
| 4,724,749 | 2/1988 | Hedrick | 55/494 |
| 4,729,074 | 3/1988 | Steadman | 52/28 X |
| 4,745,710 | 5/1988 | Davis | 52/12 |
| 4,747,341 | 5/1988 | Hedrick | 52/12 |
| 4,749,061 | 6/1988 | Orndorff et al. | 362/150 X |
| 4,765,102 | 8/1988 | Kuchem | 52/28 |
| 4,776,263 | 10/1988 | Lokander | 55/484 |
| 4,819,549 | 4/1989 | Gillingham | 55/484 |
| 4,860,420 | 8/1989 | Cadwell | 55/484 |
| 4,865,803 | 9/1989 | Dillmann | 376/314 |
| 4,883,513 | 11/1989 | Monson et al. | 52/506.07 X |
| 4,890,544 | 1/1990 | Aalpo | 454/297 |
| 4,946,484 | 8/1990 | Monson et al. | 55/385.2 X |
| 4,986,050 | 1/1991 | Brunetti | 454/297 |
| 5,192,348 | 3/1993 | Ludwig | 55/385.2 |
| 5,279,632 | 1/1994 | Decker et al. | 52/506.07 X |
| 5,454,756 | 10/1995 | Ludwig | 454/296 |
| 5,613,759 | 3/1997 | Ludwig et al. | 362/149 |
| 5,687,527 | 11/1997 | Bikard et al. | 52/506.08 |

FOREIGN PATENT DOCUMENTS

| | | | |
|---|---|---|---|
| 2625524 | 7/1989 | France | 454/187 |
| 2641667 | 3/1978 | Germany | 454/187 |
| 62-138635 | 6/1987 | Japan | 454/187 |

*Primary Examiner*—Beth Aubrey
*Attorney, Agent, or Firm*—Keith A. Cushing

[57] ABSTRACT

A ceiling structure for retaining air filter panels having a grid of interconnected rails. Each rail has a recessed channel for containing a light fixture so that the light fixture does not hang below the ceiling surface. The structure may also include hanger hooks attachable to the rails for suspending fixtures, wall panels, and pivoting wall headers to permit angled arrangements of wall panels. The light fixture attached within the channel is an extruded panel that snaps into the channel and which includes standard light tube connectors.

17 Claims, 12 Drawing Sheets

CLEAN ROOM CEILING STRUCTURE LIGHT FIXTURE WIREWAY

CROSS REFERENCE TO RELATED APPLICATION

This application is a divisional application of and allowed application Ser. No. 08/390,803, filed Feb. 14, 1995 and issued Mar. 25, 1997 as U.S. Pat. No. 5,613,759, which was a continuation of application Ser. No. 08/292,055, filed Aug. 17, 1994, now abandoned, which was a continuation of application Ser. No. 08/166,593, filed Dec. 13, 1993, now abandoned, which was a continuation of application Ser. No. 07/959,495, filed Oct. 9, 1992, now abandoned, which was a continuation of application Ser. No. 07/739,693, filed Aug. 2, 1991, now abandoned, which was a continuation-in-part of application Ser. No. 07/720,186, filed Jun. 24, 1991, now abandoned.

TECHNICAL FIELD

This invention relates to ceiling panel support structures and more particularly to structures for supporting clean room air filter panels for providing an air-tight seal at the edge of such filter panels.

BACKGROUND OF THE ART

Filter panel support grids are well-known. Existing grids use formed steel sheets as segments that are welded together to form a unitary grid structure. This requires large assemblies to be constructed and finished on the site at which they are to be installed. Consequently, manufacturing costs are high and the lack of control over the manufacturing environment may result in quality problems. Also, welded structures lack an aesthetic appearance which is desired in many applications.

As an alternative to welded structures, some existing ceiling grids employ extruded aluminum segments which are mechanically attached to provide a unitary structure. These attachment methods are generally cumbersome, requiring further modification of the grid segments by precise machining. Such methods employ attachment methods which result in a grid structure lacking in rigidity.

In an industrial manufacturing environment in which ceiling filters are typically employed, there is a need for overhead lighting and for suspension of equipment and materials. Known ceiling grid structures suspend lights from the ceiling and hang lightweight objects from screws which engage the lower surfaces of grid rails. Such threaded connections have limited capacity to carry heavy weights. Therefore, numerous screw holes are required for carrying heavy loads. In addition, when equipment and lights are removed, screws are removed from the grid; the resulting empty screw holes present an unattractive appearance.

The use of overhead lighting in conjunction with existing filter panel support grids has several disadvantages because the necessary light fixtures extend below the ceiling lower surfaces. First, such light fixtures prevent any dividers or walls from reaching the ceiling surface when suspended below a light fixture. This impairs the air flow isolation that may be desired between zones. Second, clean room ceiling height is generally limited and at a premium due to the equipment and duct work required above the ceiling and below the floor. The suspension of light fixtures below the ceiling serves further to reduce this already limited ceiling height. Third, the suspension of lights below the ceiling surface creates a safety and contamination risk, as the fixtures are susceptible to accidental impact which may cause damage or dislodge contaminants.

The use of suspended light fixtures limits the capacity and flexibility to hang further items from the ceiling structure. A suspended item is fixed once installed, and the installation labor must be repeated if the fixture is to be moved, even if only by a small amount. The installation of hanging walls and dividers is limited to orthogonal orientations directly aligned with grid structure elements. A suspended light fixture may not be installed in the same location as a suspended wall, nor may a wall intersect a suspended light structure without being spaced below the light, leaving a substantial gap between the wall and ceiling. In addition, structures suspended below lights impair access to the light, making the removal of light tubes difficult or impossible.

Light fixtures that are suitable for use on existing filter panel support grids are generally too bulky for a low profile, retro-fit installation. In addition, these fixtures are generally designed as needlessly rigid units which are costlier than required and more cumbersome to install.

From the foregoing it will be recognized that there is a need for a filter support structure that overcomes these drawbacks of the prior art by providing illumination without creating safety and contamination problems, and without restricting the flexibility of wall arrangements. The present invention satisfies this need. The foregoing and additional features and advantages of the present invention will be more readily apparent from the following detailed description which proceeds with reference to the accompanying drawings.

Figure 2:
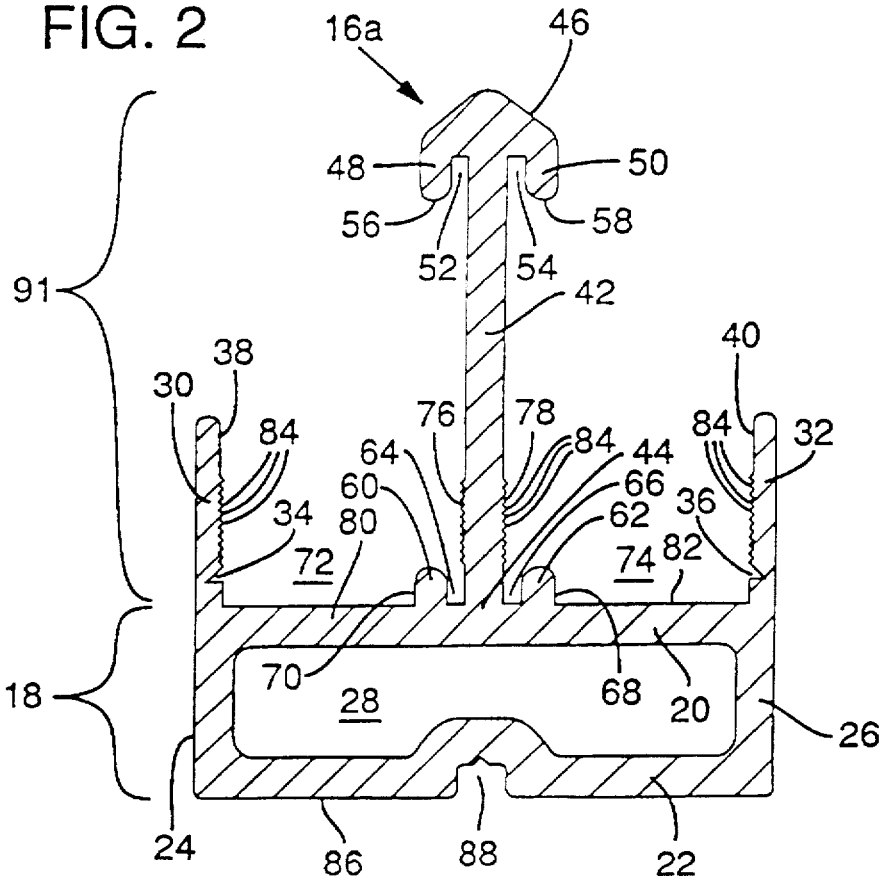
FIG. 2 is a sectional end view of an interior rail of the apparatus of FIG. 1.
Figure 3A:
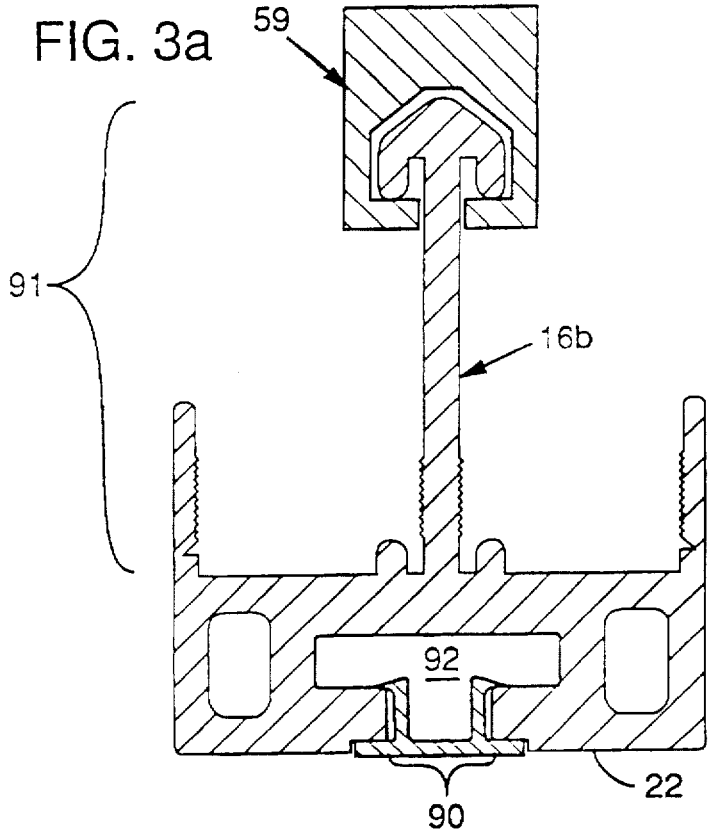
FIG. 3*a* is a sectional end view of an alternate embodiment interior rail of the apparatus of FIG. 1.
Figure 3B:
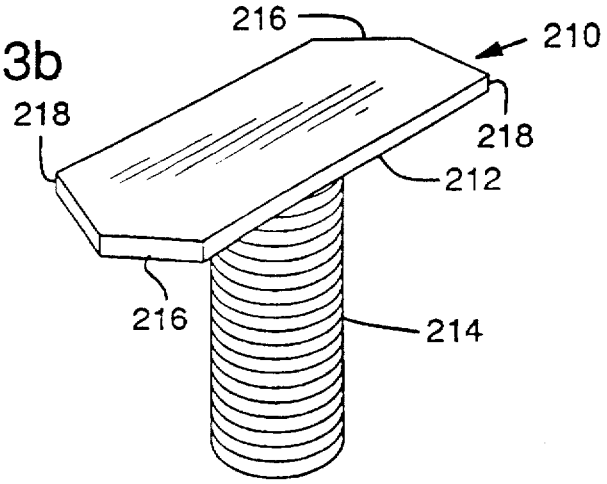
FIG. 3*b* illustrates a T-shaped bolt.
Figure 4:
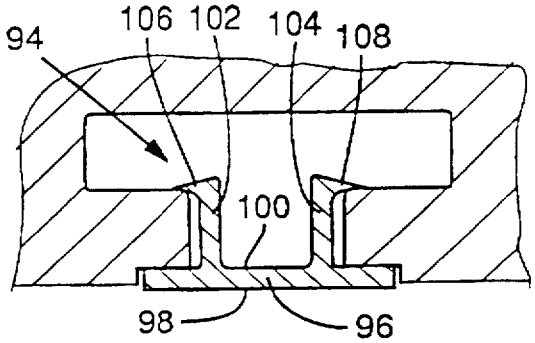
FIG. 4 is a sectional end view of a closure strip which engages the apparatus of FIG. 3*a*.

similar to that of the embodiments of FIGS. 2 and 3. In this embodiment, the side walls 24, 26 are substantially extended downward to a length approximately equal to the width of the upper wall 20. Each side wall is terminated at its lower edge by a lower wall segment 110, 112, which extends horizontally inward toward the other. The lower wall segments are terminated by upwardly projecting vertical segments 114, 116.

First and second hook receiving gaps 118, 120 are upwardly open V-shaped spaces. The first hook receiving gap 118 is defined by the side wall 24 and the vertical segment 114. The second hook receiving gap 120 is defined by the side wall 26 and the vertical segment 116. The lower wall segments define a lower gap 122 therebetween, which is preferably at least 2 inches wide to receive a fluorescent tube light fixture (not shown) between the side walls. The side walls 24, 26 extend sufficiently downward from the upper wall 20 so that a fluorescent tube light fixture (not shown) may be entirely received within a light fixture tunnel 124 defined therebetween.

Figure 6:
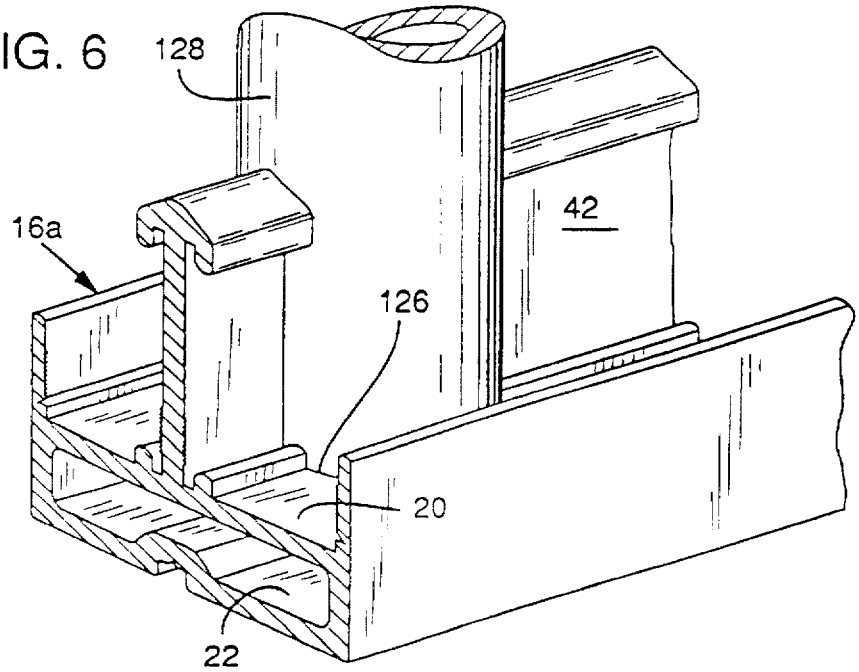
FIG. 6 is an isometric sectional view of an interior rail of the apparatus of FIG. 1 having a conduit passing therethrough.

FIG. 6 shows an interior rail 16*a* in which the upper wall 20 and lower wall 22 as well as the hanger wall 42 have been drilled to provide a conduit hole 126 which is configured to closely receive a sprinkler pipe 128 or a grommeted electrical conduit (not shown). The conduit or pipe 128 is sealed to the conduit hole 126 at the upper wall 20, such that fluid may not penetrate between the sleeve and the hole. The hardware of any conduit connectors should be low-profile so that any seams between the hardware and the conduit reside below the level of the gel sealant. As a result, any air leaks in the connection will be properly sealed.

Figure 7:
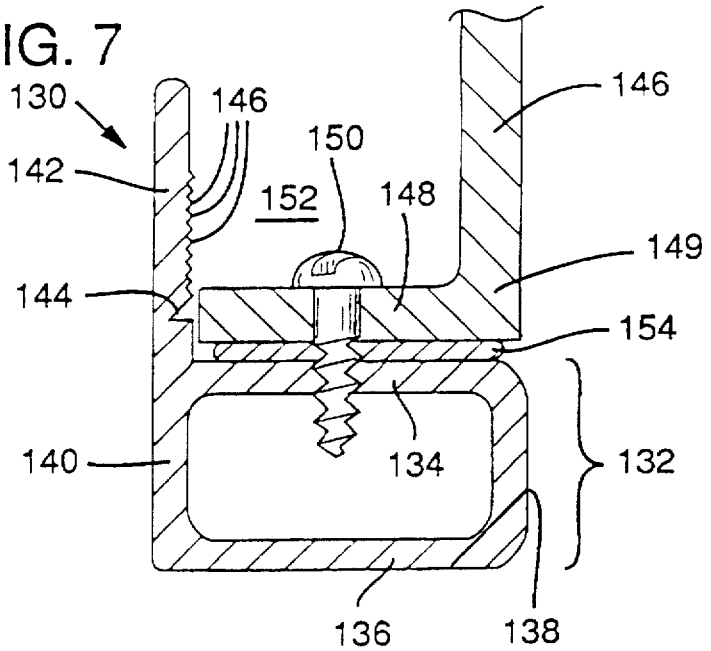
FIG. 7 is a sectional end view of a perimeter rail of the apparatus of FIG. 1.

FIG. 7 shows a perimeter rail 130, having a hollow rectangular body 132, having an upper wall 134, a lower wall 136, a distal side wall 138 facing away from the grid structure and a proximate side wall 140 opposite the distal side wall. A single perimeter trough wall 142, projects perpendicularly upward from the upper wall 134, of the perimeter rail in the plane of the proximate side wall 140. The trough wall includes the narrowed portion 144 as provided in the rail of FIG. 2. The trough wall also has a similar plurality of V-shaped ridges 146 on the side of the trough wall facing the distal side wall 138.

A vertical plenum wall 146, has a horizontal plenum flange 148 attached to a lower edge 149 of the plenum wall. The flange is attached to the upper wall 134, by suitable attachment means such as a screw 150. Sealant 154 is provided between the flange and the upper wall so that a gel may be contained in a trough 152 defined between the trough wall and the plenum wall.

Figure 8:
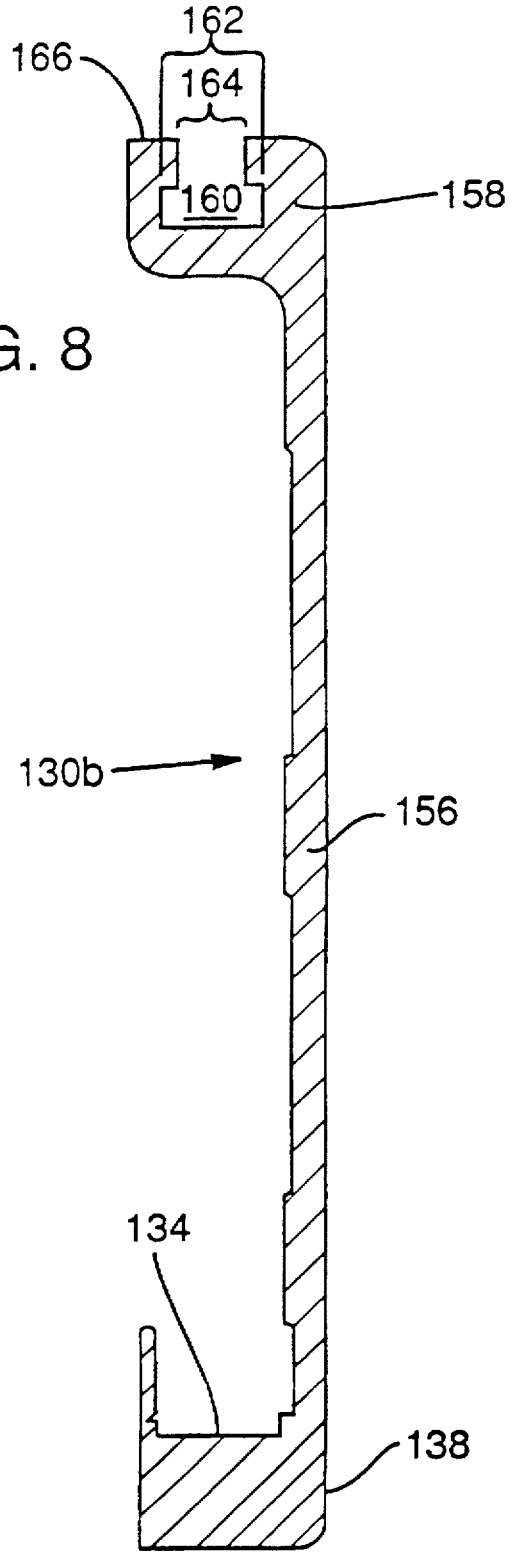
FIG. 8 is a sectional end view of an alternative embodiment perimeter rail of the apparatus of FIG. 1 having a suspension wall.

As shown in FIG. 8, a perimeter rail 130*b* is provided with a vertical suspension member 156 integrally formed therewith. The suspension member is a planar wall projecting vertically upward from the upper wall 134 of the perimeter rail in the plane of the distal side wall 138. The suspension member is upwardly terminated by an enlarged portion 158, having a bolt head receiving slot 160 defined therein. The slot has an interior width 162, sized to retain a bolt head (not shown) and has a narrower aperture width 164, sized to permit passage of a bolt shank. A plenum (not shown) is attached to an upper surface 166 of the enlarged portion 158 and fixed thereto by means of bolts retained in the bolt head receiving slot 160.

Figure 9:
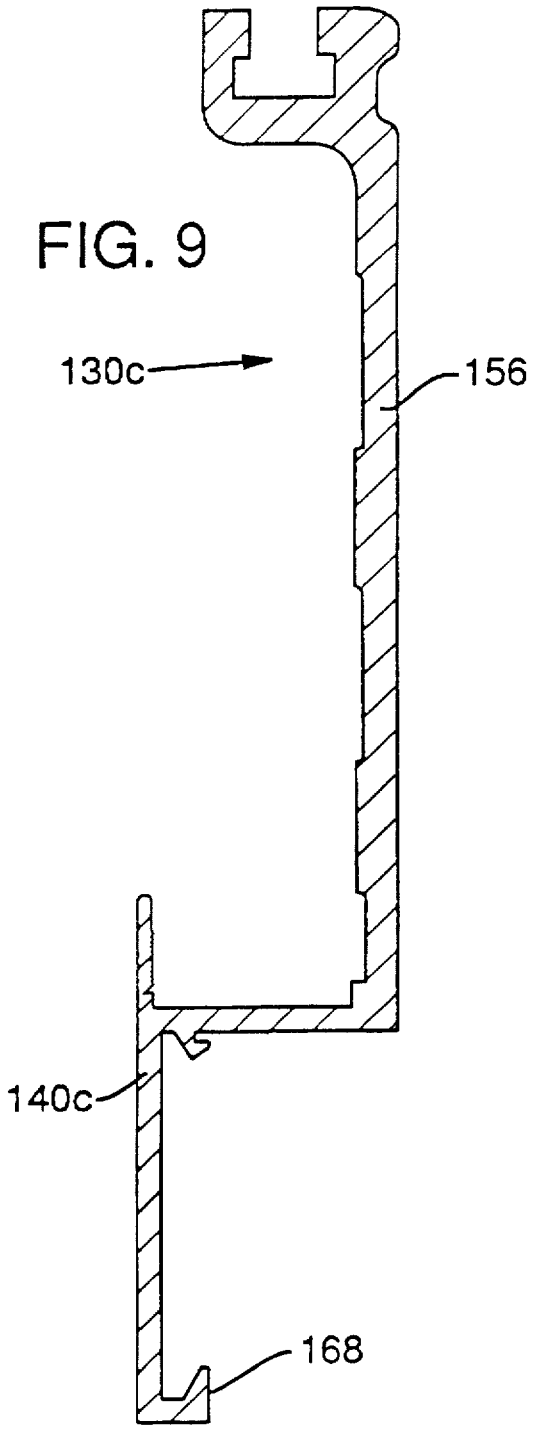
FIG. 9 is a sectional end view of a perimeter rail in an alternative embodiment having a suspension wall and a side wall having a hook shaped lower portion.

As shown in FIG. 9, an alternate perimeter rail 130*c* shares the vertical suspension member 156 of the FIG. 8 embodiment, but does not have a lower wall 136 or a distal side wall 138. In the FIG. 9 embodiment, the proximate side wall 140*c* is extended downward and terminated by a hook-shaped portion 168 similar to that which defines the hook receiving gaps of FIG. 5.

Figure 10:
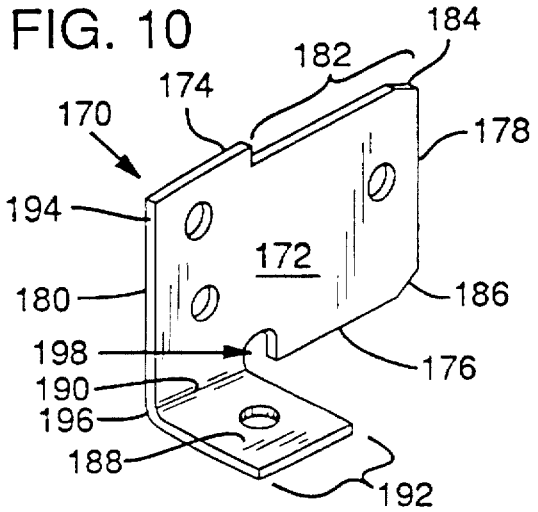
FIG. 10 is a perspective view of the bracket employed in the apparatus of FIG. 1.

As shown in FIG. 10, an attachment bracket 170 is stamped and formed from a sheet of steel. The bracket comprises a rectangular planar sheet 172, having a top edge 174, a bottom edge 176, a first side edge 178 and a second side edge 180. A blade portion 182 having a pair of beveled corners 184, 186, is configured to be received by a vertical rectangular space defined between the rectangular clip gap 52 (or alternatively 54) and the base gap 64 (alternatively 66) in the end of one of the interior rails 16*a*, 16*b* or 16*c*.

The bracket 170 includes an attachment tab 188 attached to a bent portion 190 of the bottom edge 176 of the rectangular sheet 172. The attachment tab is formed by bending it 90 degrees from the plane of the sheet so that it extends perpendicularly from the sheet. The attachment tab has a tab width 192, sized to be attached to the upper wall 20, of an interior rail body 18, and to be closely received between the inner side 38 of the first trough wall 30 and the first ridge 60 or, alternatively, between the inner side 40 of the second trough wall 32 and the second ridge 62 of the rail shown in FIG. 2.

The second side edge 180 of the bracket sheet 172 is vertical and has an upper contact point 194 and a lower contact point 196. The upper contact point is adjacent to the top edge 174 of the sheet and the lower contact point is adjacent to the bottom edge 176 of the sheet at the bent portion 190.

A generally semicircular cutout 198 is defined by the bottom edge 176 of the sheet 172 adjacent to the attachment tab 188 to provide access to seams 202 (shown in FIG. 12) in the completed assembly for sealing with caulk to prevent leakage, as will be discussed below.

It should be noted that the bracket may be formed in a mirror image configuration with the tab 188 bent in the opposite direction. Thus, there will be right handed brackets, as shown in FIG. 10, and left handed brackets 170' as shown in FIG. 11.

Figure 11:
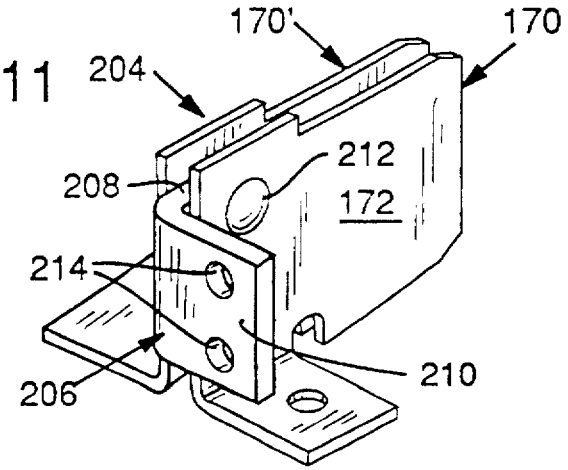
FIG. 11 is a perspective view of a junction assembly of the apparatus of FIG. 1.

FIG. 11 shows a junction assembly 204. The junction assembly is formed by right handed bracket 170 and left handed bracket 170', with the rectangular sheets 172 thereof in parallel spaced-apart relation. An L-shaped bracket 206 includes a planar spacer portion 208 with a planar mounting portion 210 perpendicularly attached thereto. The L-shaped bracket 206 is preferably formed of bent sheet metal. The spacer portion 208 is received between the brackets 170, 170' and is fixed therebetween by junction screws or rivets 212 so that the mounting portion 210 is perpendicular to the bracket sheet 172 and to the attachment tab 188. The mounting portion 210 defines a pair of mounting holes 214 sized to receive suitable fasteners.

Figure 12:
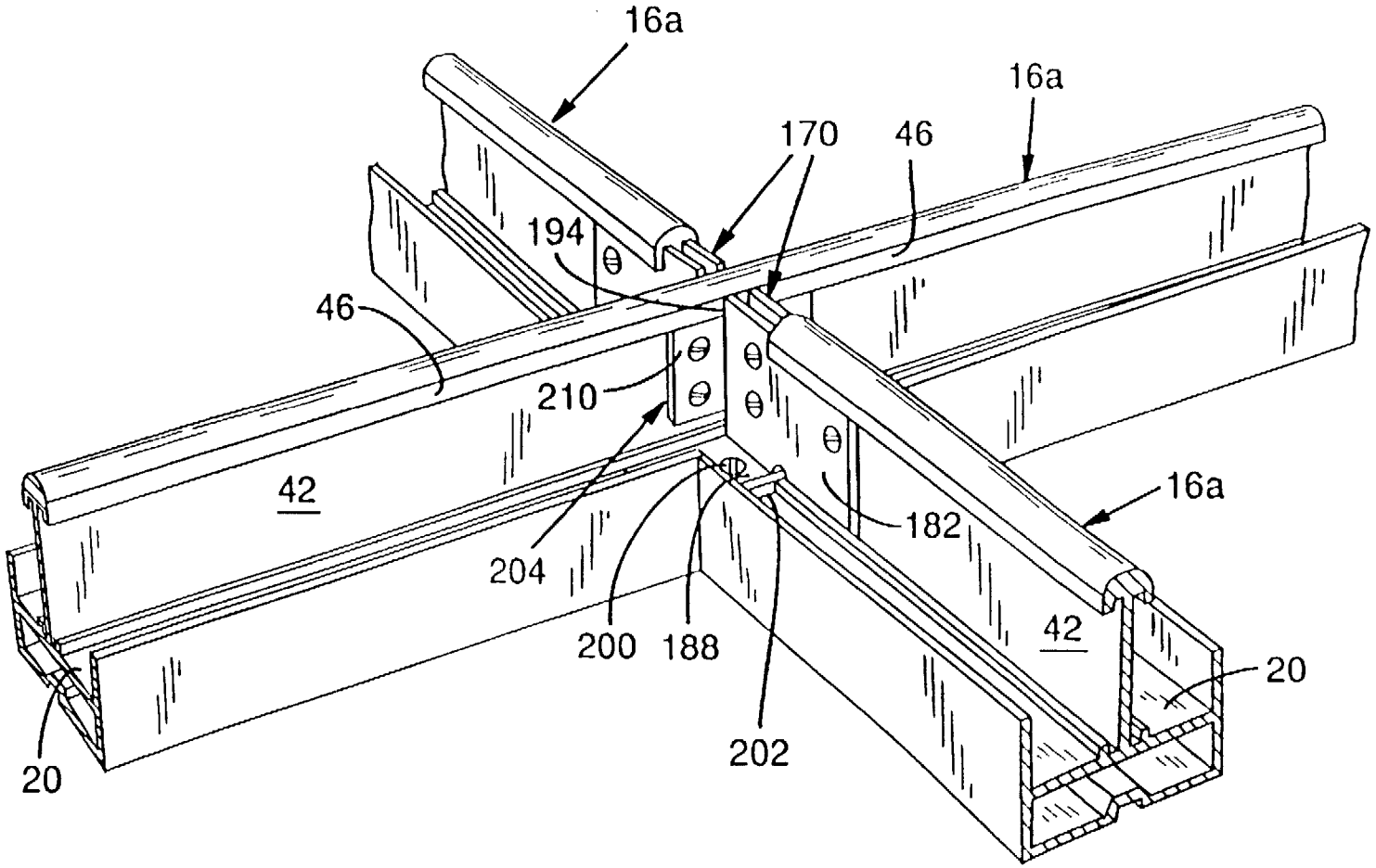
FIG. 12 is a perspective view of an assembled junction between grid rails of the apparatus of FIG. 1.

As shown in FIG. 12, each junction between the end of the interior rail 16*a* and the side of another interior rail requires a junction assembly 204. A portion of the trough wall of the rail whose side forms the junction is vertically cut and broken off as discussed above with reference to FIG. 2. As discussed above, the blade portions 182 of the brackets 170 are inserted into the end of the interior rail on opposite sides of the hanger wall 42. The bracket tabs 188 are attached to the upper wall 20 of the adjacent interior rail by suitable means such as a screw 200. The mounting portions 210 of the L-shaped brackets 206 are positioned against the hanger wall 42 and fixed thereto by suitable fasteners. The upper contact point 194 of the bracket thereby contacts the widened portion 46 of the hanger wall 42 to prevent undesired angular wobble of the rails at the junction, and to prevent the joint from flexing under compressive forces between the rail members. The junction seam 202 is sealed with suitable means such as caulk, so that the troughs may be filled with a gel-like sealant which will sealably receive filter panels 12 having downwardly depending edge flanges (not shown).

Figure 5:
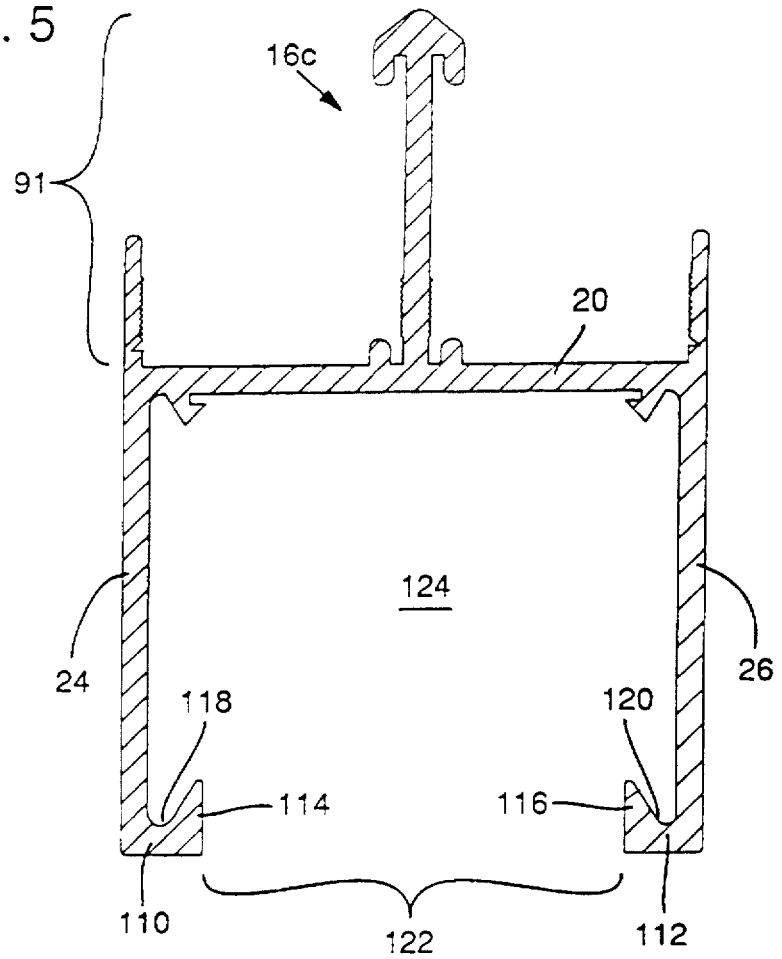
FIG. 5 is a sectional end view of an interior rail of the apparatus of FIG. 1 in an alternative embodiment to accommodate light fixtures and hanging fixtures.
Figure 13:
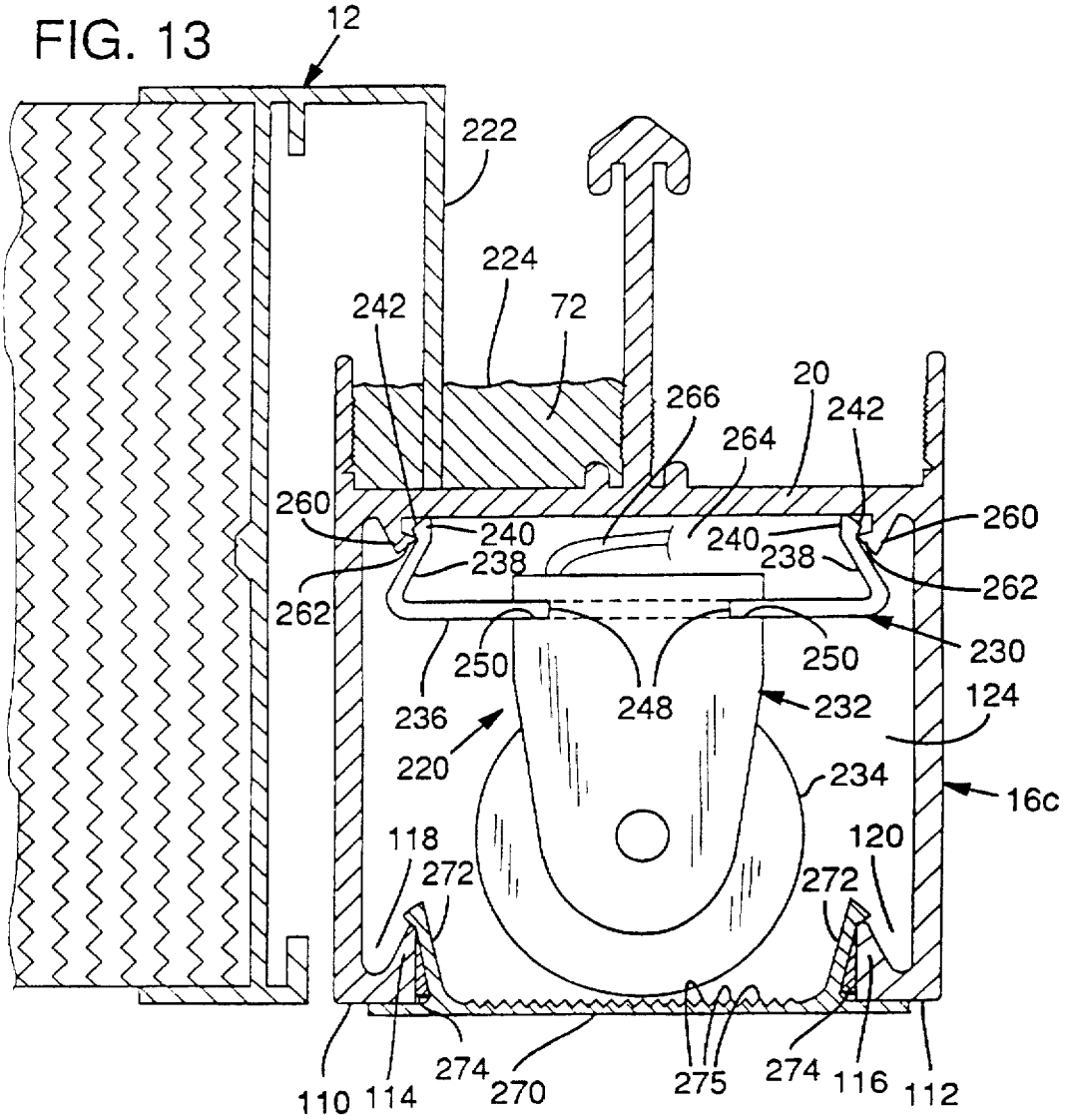
FIG. 13 is a sectional end view of an interior rail of the apparatus of FIG. 1 in an alternative embodiment with an enclosed light fixture.

FIG. 13 shows the rail member of FIG. 5 with a light fixture assembly 220 installed and completely received within the rail channel 124. The filter panel 12 is shown having a downwardly depending peripheral blade edge 222 received in the first sealant receiving trough 72 and sealed by a gel sealant 224.

The light fixture assembly 220 generally comprises an elongated light chassis panel 230 attached to the interior of the rail channel 124, with a standard bulb retainer or tombstone 232 attached at each end of the chassis panel 230. A fluorescent tube 234 is electrically connected to and received between the bulb retainers 232 so that the entire light fixture assembly 220 is contained within the channel 124.

The light chassis panel 230 is preferably formed of extruded aluminum and has a length somewhat longer than the standard fluorescent light tube 234. In cross-section, the chassis panel 230 appears as a broad, flat-bottomed trough. A chassis base 236 forms the bottom of the trough and is generally flat, with a width somewhat less than the interior width of the rail channel 124. Along each edge of the chassis base 236, a chassis wall 238 projects generally upwardly and slightly inwardly from the base. Each chassis wall is terminated at an upper free end 240 by a chassis lip or chassis hook 242 that projects horizontally outward. The walls and base of the chassis panel 230 are sufficiently thin so that the walls may be slightly inwardly biased as necessary for installation and removal.

Figure 14:
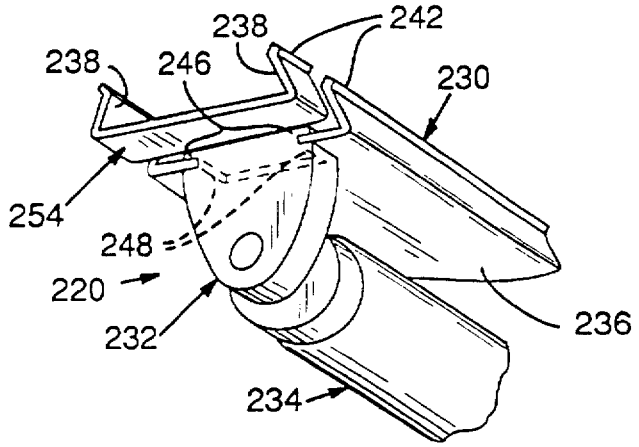

As shown in FIG. 14, the chassis panel 230 defines at each end a rectangular gap 246 that is preferably formed by removing a central rectangular portion of the chassis base 236 at each end to form opposed, parallel, inwardly facing gap edges 248. The gap has a depth generally equal to the thickness of the tombstone 232.

As shown in FIGS. 13 and 14, the bulb retainer or tombstone plug 232 is slidably received in the rectangular gap 246 of the light chassis panel 230 so that the tombstone is flush with the end of the chassis panel. The tombstone 232 is a standard off-the-shelf component such as the Slide-On Slimline Tombstone manufactured by Kulka Wiring Devices, Part No. 1630-1,2. The tombstone 232 defines a pair of opposed slots 250 sized and spaced apart to slidably receive the gap edges 248 of the chassis panel 230. A tombstone is thus inserted at each end of the chassis panel so that the tombstones are suitably spaced apart to removably retain and to electrically contact the fluorescent lamp tube 234. To prevent the tombstones from shifting outwardly from their fully installed positions, a retaining section 254 having the same cross-section as the light chassis panel 230 is placed against the chassis base 236 externally of each tombstone 232 so as to cover the remaining open portion of each rectangular gap 246.

Figure 1:
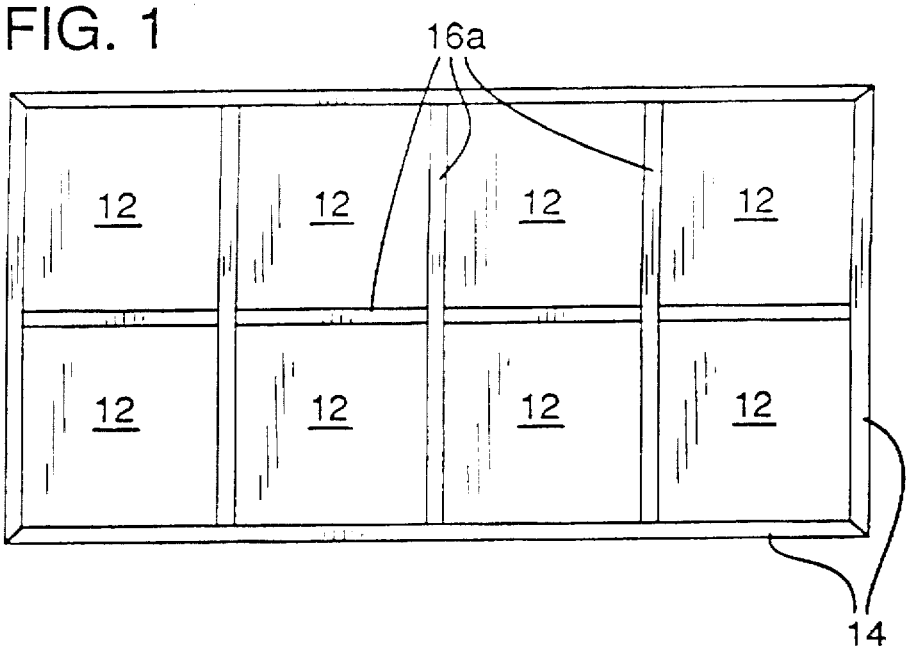
FIG. 1 is a schematic plan view of an apparatus according to the present invention.

The retaining section 254 attaches to the rail channel 124 so that the section is retained in the channel in the same manner as the chassis panel 230. The section 254 has a length generally equal to the distance between the outer face of the tombstone 232 and the end of the chassis panel 230. When the rail member **16*c* is installed as shown by rail members 16*a* in FIG. 1, the rail end will abut the side of the adjacent rail member, thereby preventing the retaining section 254 and tombstone 232 from sliding outwardly beyond the end of the rail member 16*c***.

As shown in FIG. 13, the upper wall 20 of the rail member **16*c* includes a pair of opposed channel ledges 260 widely spaced apart on the lower surface thereof by a sufficient distance to permit a mating snap fit with the chassis hooks 242 of the chassis panel 230. The ledges, shown differently in FIG. 13 than in the original embodiment of FIG. 5, each have an inwardly facing nose 262 spaced below the surface of the upper wall to define a gap for receiving the chassis hook 242**.

The upper wall 20 of the rail member and the chassis panel 230 cooperatively define an elongated wireway 264 to permit passage of a wire 266 extending from the tombstone 232 to a conduit or aperture 126 as shown in FIG. 6.

As further shown in FIG. 13, a lens or closure strip 270 encloses the channel 124 between the projections 114, 116. The lens is preferably an extruded plastic strip of transparent or translucent material, such as a resilient plastic. The lens is a flat, elongated body that rests against the lower surfaces of the rail member lower wall segments 110, 112 and has a pair of upwardly and outwardly projecting lens legs 272 to engage the rail member projections 114, 116. A pair of lens gaskets 274 each runs the length of the lens between one of the rail member projections 114, 116 and one of the lens legs 272. In addition to protecting the light bulb from damage, the lens and gaskets prevent dust and debris from escaping the channel into the environment below. The lens may be textured with ridges 275 shown or otherwise optically formed to provide a controlled illumination pattern. Because divider walls and other objects need to be suspended from the grid, the lens is nearly flush with the rail to prevent interference with such hanging objects.

Figure 15:
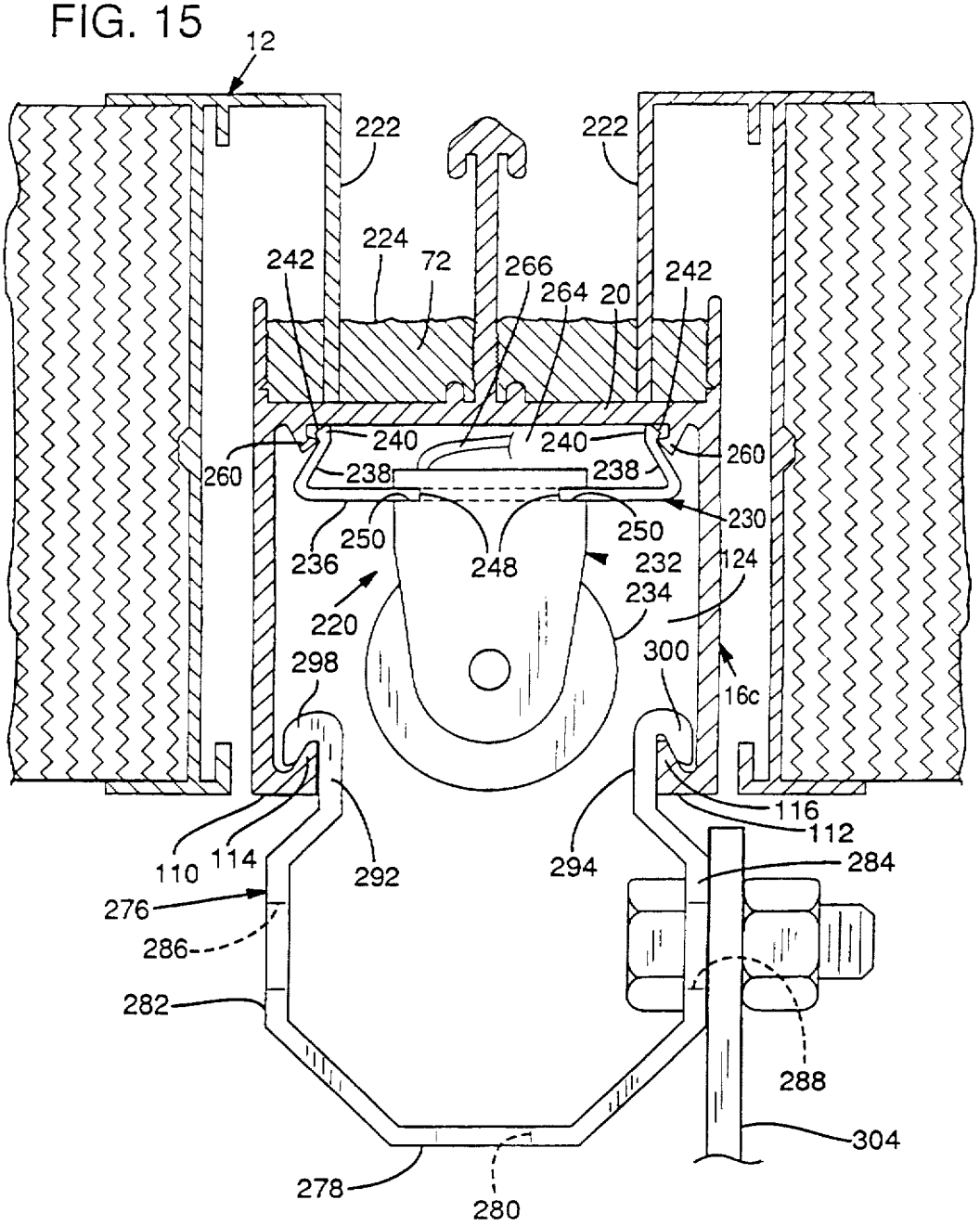

FIG. 15 shows the rail member **16*c* with the light fixture 220 installed, and with a hanger 276 hanging below the rail member. The hanger is a generally U-shaped metal bracket preferably formed by extrusion, with each hanger being about a two inch length from source extrusion. Each hanger 276 has a flat lower portion 278 with a lower attachment hole 280 defined therein. The hanger has opposed parallel first and second sides 282, 284 projecting upward from the lower portion 278 and positioned in vertical planes perpendicular to the lower portion 278 and defining, respectively, first and second side attachment holes 286, 288. The first and second sides form the widest portion of the hanger, providing attachment points for suspending items below without interfering with other portions of the hanger. Attached respectively above the first and second hanger sides 282, 284 are first and second upper sidewalls 292, 294**.

The upper sidewalls are spaced apart sufficiently to permit the fluorescent tube 234 to be passed between them to permit its removal. Each upper sidewall is terminated at its free end by a hanger hook 298, 300 that curves outwardly and downwardly to engage the projections 114, 116 of the rail member **16*c*. Normally, the hanger hooks 298, 300 are spaced more widely apart than the lower aperture of the rail member 16*c* so that the projections seat in the hook receiving gaps 118, 120 when the hanger is subject to a downward force. For removal and installation, the hanger sides may be biased together to inwardly compress the hooks, permitting one hanger hook to pass in or out of the rail channel 124**.

A hanging panel 304 or similar fixture may be suspended from the hanger at one of the attachment holes 286, 288. Items suitable for suspending from the hanger include: monorail material transport systems, smif-type equipment enclosures, and other process tools and equipment. A standard bolt or other suitable means may be used to secure the panel 304 to the hanger.

Figure 16A:
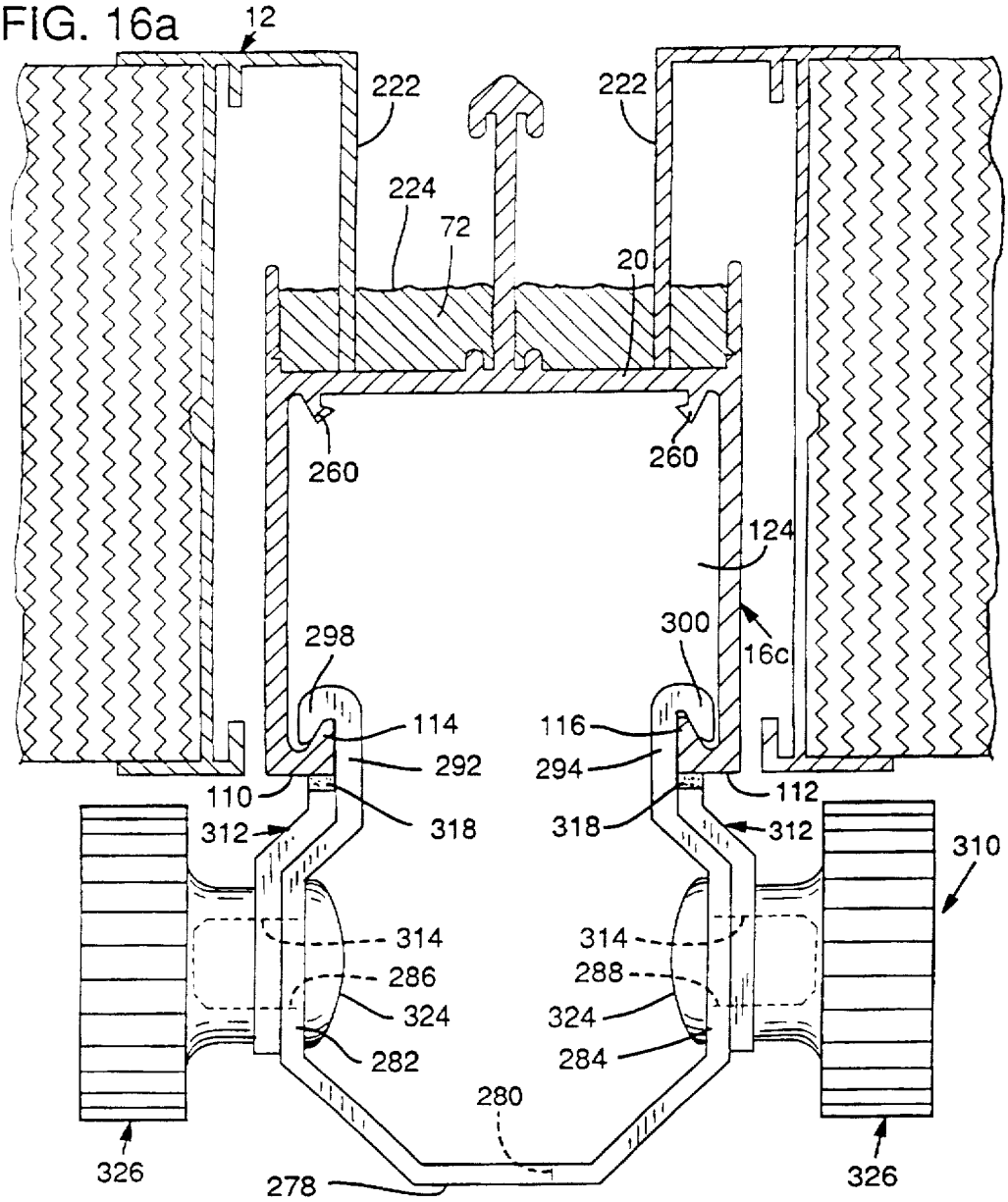
Figure 16B:
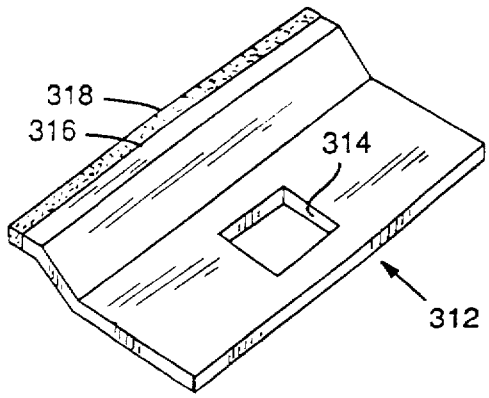

FIGS. 16*a* and 16*b* show a grid hanger clamping mechanism 310 for securing the grid hanger 276 to the rail member 16*c* to prevent sliding or removal of the hanger. A pair of clamping plates 312 are positioned on opposite sides of the hanger 276, adjacent to the first and second sides 282, 284 respectively. Each plate 312 is a rigid metal plate that is articulated to conform to the general contours of the sides of the grid hanger 276. Each plate defines a plate aperture 314 sized to correspond with the first and second attachment holes 286, 288 and positioned to register with one of such holes when the plate is positioned in conformity with the contours of the grid hanger 276. Each plate is terminated by an upper plate edge 316 that is positioned to compressively contact the corresponding lower wall segment 110, 112 of the rail member 16*c* when the plate 312 is compressed against the hanger 276. The upper plate edge preferably includes a resilient plate gasket 318 to prevent slippage and to avoid cosmetic damage to the rail member.

A clamp bolt 324 and a clamp knob 326 are provided to adjustably secure each clamp plate 312 to the hanger 276. Each bolt 324 is sized to penetrate the first or second attachment hole 286, 288 and the plate aperture 314, and to extend outwardly from the hanger 276. Each clamp knob threadably engages the respective bolt to compress each plate 312 against the corresponding hanger side 282, 284. Additionally, the panel 304, as shown in FIG. 15, may be attached to the hanger 276 along with the plate 312.

Figure 17A:
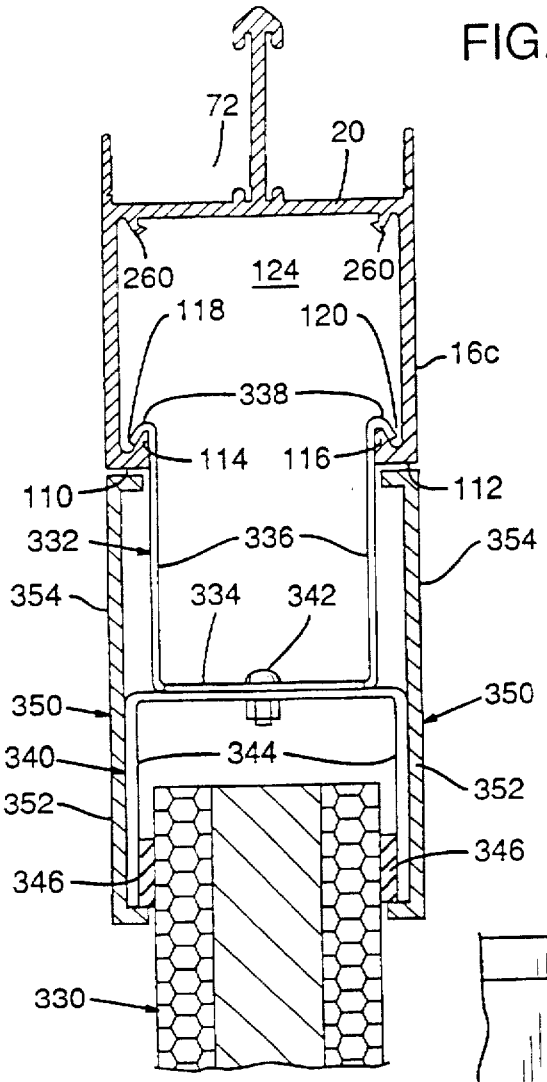

Floor to ceiling walls are often required to subdivide clean room areas, and must be secured to the ceiling. FIG. 17*a* shows a wall header for pivotally attaching a wall panel 330 to the rail member 16*c*. An upwardly open U-shaped header clip 332 has a flat base portion 334 with two upwardly extending legs 336, each leg being terminated at its free end by an outwardly and downwardly extending clip hook 338. The clip hooks are sufficiently spaced apart and properly configured to securely engage the projections 114, 116 of the rail member 16*c* when the header clip 332 is subject to a downward force.

A U-shaped downwardly open wall header channel 340 is pivotally attached to the header clip 332 at a header connection 342. The header connection preferably comprises a nut and bolt passing through similarly sized apertures in the base of the header clip 332 and the corresponding portion of the header 340. The header includes a header base 342 and header side walls 344 depending downwardly therefrom. The side walls are spaced apart by a distance greater than the width of the wall panel 330, the upper edge of which is received therein. A header gasket 346 formed of rubber or other resilient material is attached to the lower portion of the interior side of each header side wall 344 along the entire length of the side wall. Each gasket 346 faces the opposite side wall so that the wall panel 330 forms a seal with the gaskets when installed in the header channel 340.

A pair of side plates 350 is attached to the header 340, one each to the outer side of each header side wall 344. A lower side wall portion 352 of each side plate 350 is generally coextensive with the header side wall 344, and an upper side wall portion 354 extends upwardly, terminating in proximity with the lower wall segments 110, 112 of the rail member 16*c*.

Figure 17B:
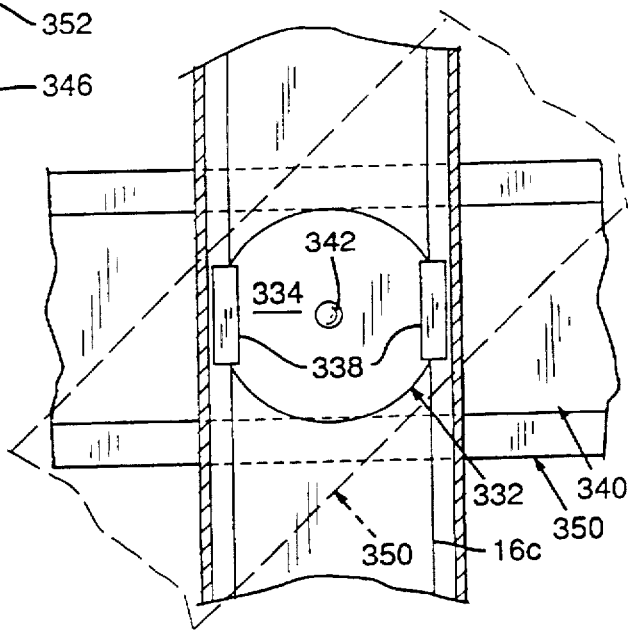

As shown in FIG. 17*b*, this permits the header 340 to be rotated about the header connection 342 without the side plates 350 interfering with the rail member 16*c*, yet does not permit substantial air flow between the rail member 16*c* and the side plates 350. Thus, the wall may be effectively used to isolate air flow zones.

Figure 18:
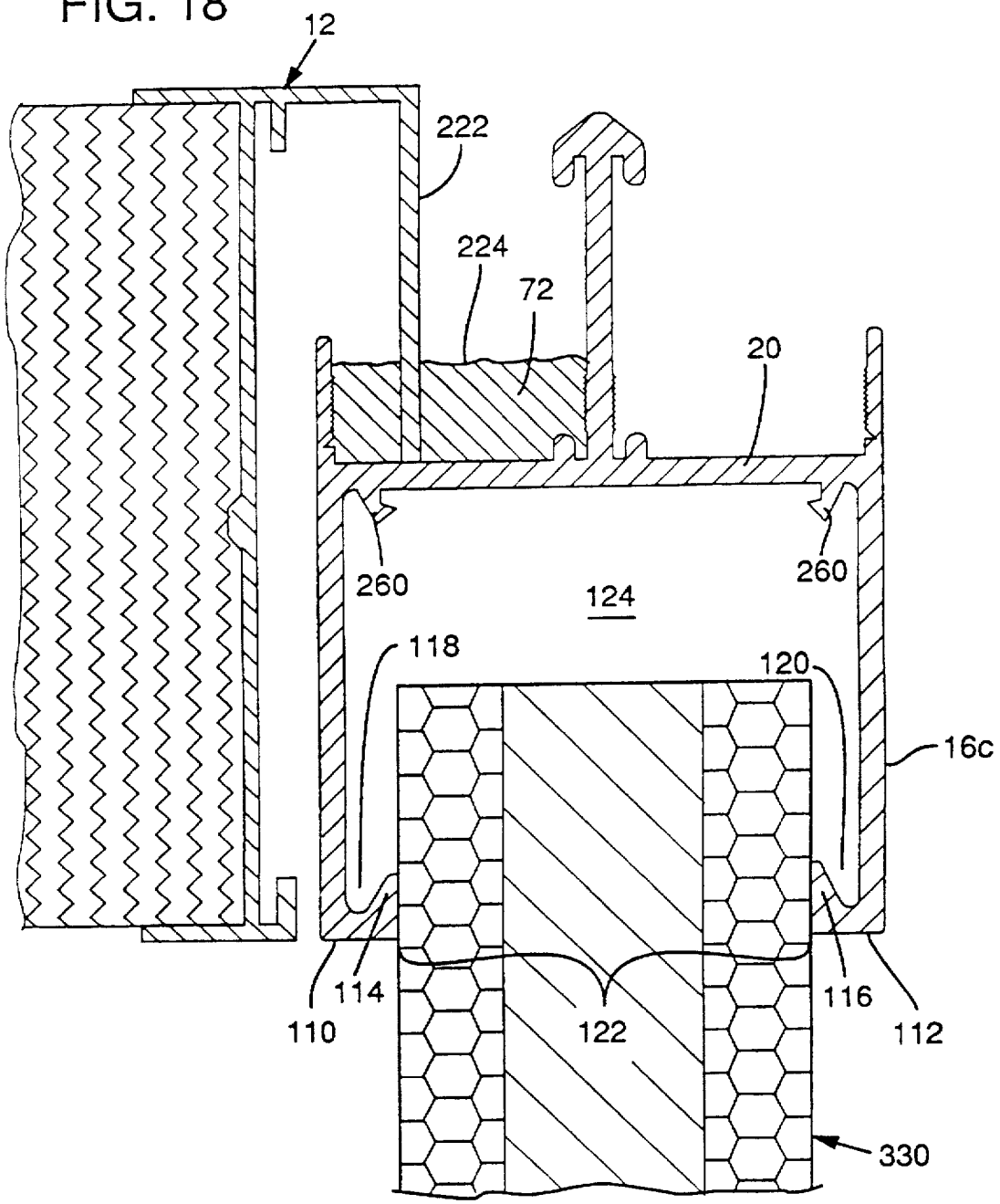

FIG. 18 shows a wall panel 330 inserted directly in the rail channel 124 of the rail member 16*c* with the space normally occupied by a light fixture used as a wall header. The lower gap 122 defined by the lower wall segments 110, 112 is sized to closely receive the wall panel to prevent substantial leakage of air flow from one side of the panel to the other. Alternatively, a thinner wall panel may be used with spacers or gaskets to provide an effective seal.

Additional disclosure which may be useful in constructing an apparatus according to the present invention may be found in U.S. Pat. Nos. 3,280,984, 3,432,999, 3,487,766, 3,630,008, 3,715,578, 3,740,934, 3,782,082, 3,975,995, 4,600,419, 4,608,066, 4,671,811, 4,678,487, 4,724,749, 4,747,341, 4,819,549, 4,860,420, 4,883,513 and 4,946,484, the disclosures of which are incorporated herein by reference.

Having illustrated and described the principles of my invention by what is presently a preferred embodiment thereof, it should be apparent to those persons skilled in the art that the illustrated embodiment may be modified without departing from such principles. I claim as my invention not only the illustrated embodiment, but all such modifications, variations and equivalents thereof as fall within the true spirit and scope of the following claims.

I claim:

1. A ceiling structure for a clean room including air filters, the ceiling structure comprising:

a grid for supporting said air filters and including at least one rail, said rail defining a downward-facing channel;

a light fixture including a light tube and associated wiring providing electrical power to said light tube, said light fixture being maintained within said downward-facing channel; and a wireway panel attachable within said downward-facing channel and establishing thereabove a wireway enclosure within said downward-facing channel whereby said associated wiring routes through said wireway enclosure and said light tube is located below said panel.

2. The ceiling structure according to claim 1 wherein said panel releasably attaches within said downward-facing channel.

3. The ceiling structure according to claim 1 further comprising a light transmissive panel enclosing said downward-facing channel and located below said light tube.

4. The ceiling structure according to claim 1 wherein said light fixture further comprises first and second bulb retainers positioned within said downward-facing channel to mechanically secure said light tube within said downward-facing channel and to electrically couple said light tube and said associated wiring.

5. The ceiling structure according to claim 4 wherein said first and second bulb retainers electrically couple said light tube and said associated wiring across a plane including said wireway panel.

6. The ceiling structure according to claim 1 wherein said rail further includes a conduit communicating with a space external of said downward-facing channel and above said rail, said associated wiring passing along said conduit and into said space.

7. A ceiling structure for a clean room including air filter panels, said ceiling structure comprising:

a plurality of rails for supporting said air filter panels, at least one of said rails including a downward-facing channel, said channel having an upper portion and a lower portion;

a light fixture including a light tube and associated wiring providing electrical power to said light tube, said light tube being maintained within said lower portion of said channel; and a wireway panel releasably attachable within said channel and defining said upper and lower portions of said channel, said wireway panel establishing said upper portion as an enclosed wireway whereby said associated wiring passes along said wireway enclosure to said light tube.

8. The ceiling structure according to claim 7 further comprising a light transmissive panel enclosing, in cooperation with said wireway panel, said lower portion of said channel whereby light produced by said light tube passes downwardly therethrough and out of said channel.

9. The ceiling structure according to claim 7 wherein said light fixture further comprises first and second bulb retainers positioned within said downward-facing channel to mechanically secure said light tube within said downward-facing channel and to electrically couple said light tube and said associated wiring.

10. The ceiling structure according to claim 9 wherein said first and second bulb retainers electrically couple said light tube and said associated wiring across a plane including said wireway panel.

11. A ceiling structure for a clean room including air filters, the ceiling structure comprising:

a grid for supporting said air filters and including at least one rail, said rail defining a downward-facing channel, said rail including a conduit communicating between said downward-facing channel and a space external of said downward-facing channel;

a light fixture including a light tube and associated wiring providing electrical power to said light tube, said light fixture being maintained within said downward-facing channel; and a wireway panel attachable within said downward-facing channel and establishing thereabove a wireway enclosure within said downward-facing channel whereby said associated wiring passes along said wireway enclosure from said conduit to said light fixture therebelow.

12. The ceiling structure according to claim 11 wherein said wireway panel releasably attaches within said downward-facing channel.

13. The ceiling structure according to claim 11 further comprising a light transmissive panel enclosing said downward facing channel and located below said light tube.

14. The ceiling structure according to claim 11 wherein said light fixture further comprises first and second bulb retainers positioned within said downward-facing channel to mechanically secure said light tube within said downward-facing channel and to electrically couple said light tube and said associated wiring.

15. The ceiling structure according to claim 14 wherein said first and second bulb retainers attach to said wireway panel.

16. The ceiling structure according to claim 14 wherein said first and second bulb retainers electrically couple said light tube and said associated wiring across a plane including said wireway panel.

17. The ceiling structure according to claim 11 wherein said rail further includes a conduit communicating with a space external of said downward-facing channel and above said rail, said associated wiring passing along said conduit and into said space.

* * * * *